United States Patent [19]

Spinnett

[11] Patent Number: 4,510,967

[45] Date of Patent: Apr. 16, 1985

[54] ANTI-BACKFLOW VALVE FOR THERAPY TUBS AND THE LIKE

[75] Inventor: Raymond G. Spinnett, Santa Ana, Calif.

[73] Assignee: KDI American Products, Inc., North Hollywood, Calif.

[21] Appl. No.: 505,786

[22] Filed: Jun. 20, 1983

[51] Int. Cl.[3] ..... A61H 9/00

[52] U.S. Cl. ..... 137/389; 137/115; 137/508

[58] Field of Search ..... 137/508, 192, 115, 389, 137/102

[56] References Cited

U.S. PATENT DOCUMENTS

| | | | |
|---|---|---|---|
| 79,436 | 6/1868 | Bechtel | 137/508 |
| 130,490 | 8/1872 | Dick | 137/398 |
| 254,130 | 2/1882 | Harrison | 251/333 |
| 914,418 | 3/1909 | Hutchins | 137/176 |
| 921,865 | 5/1909 | Miller et al. | 137/192 |
| 1,766,966 | 6/1930 | Walsh | 137/192 |
| 2,325,956 | 8/1943 | Holtman | 137/397 X |
| 2,417,494 | 3/1947 | Hoof | 251/160 |
| 2,666,448 | 1/1954 | Garretson et al. | 137/540 |
| 2,677,939 | 5/1954 | Clute | 137/389 |
| 2,854,023 | 9/1958 | Heyer | 137/432 |
| 2,886,058 | 5/1959 | Horton | 137/484.2 |
| 2,940,472 | 6/1960 | Chilcoat | 137/540 |
| 3,036,594 | 5/1962 | Salisbury | 137/536 |
| 3,171,423 | 3/1965 | Dillon | 137/218 |
| 3,180,352 | 4/1965 | Kersten et al. | 137/218 |
| 3,232,314 | 2/1966 | Koester | 137/516.29 |
| 3,672,366 | 6/1972 | Burchell et al. | 137/102 |
| 3,811,470 | 5/1974 | Schaefer | 137/540 |
| 4,166,296 | 9/1979 | Darrah et al. | 4/543 |
| 4,168,705 | 9/1979 | Raab | 128/66 |
| 4,170,044 | 10/1979 | Steimle | 4/172.15 |

*Primary Examiner*—Martin P. Schwadron
*Assistant Examiner*—James R. Shay
*Attorney, Agent, or Firm*—Gausewitz, Carr, Rothenberg & Edwards

[57] ABSTRACT

An anti-backflow valve for installation in a blower discharge line of a therapy tub aeration system has an air inlet, an air outlet, and an auxiliary outlet in its housing. A spring-loaded check valve member within the housing precludes fluid flow outwardly through the air inlet. Also within the housing is a combined pressure relief and float valve mechanism which opens the outlet passage in response to a pressure in the housing greater than a predetermined relief pressure or the presence of water in the housing above a predetermined level. An initial backflow of water in the discharge line closes the check valve member, the float and relief mechanism limiting the air pressure building caused by a continued backflow and permitting water to enter the housing through the air inlet when the housing is vented. After reaching the predetermined level in the housing, the entering water is discharged through the auxiliary outlet passage.

15 Claims, 5 Drawing Figures

FIG. 1.
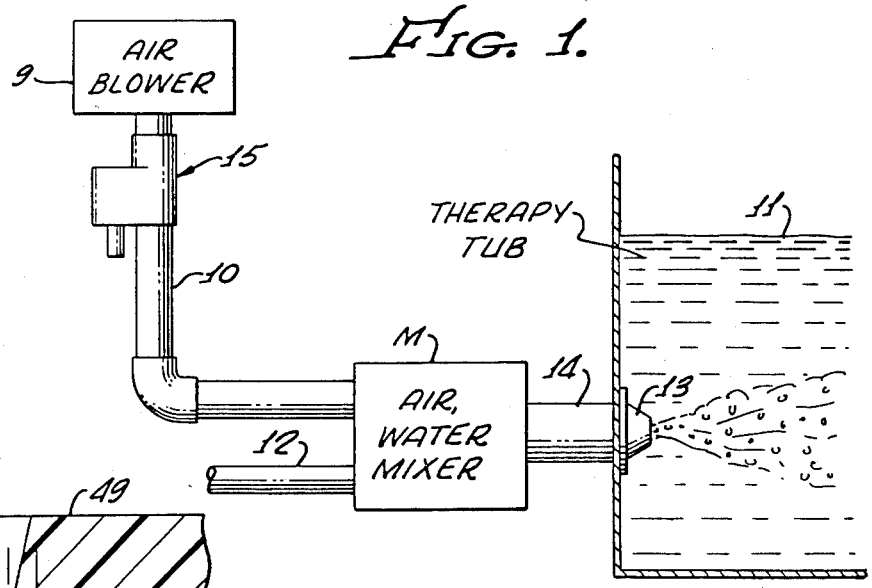
FIG. 5.
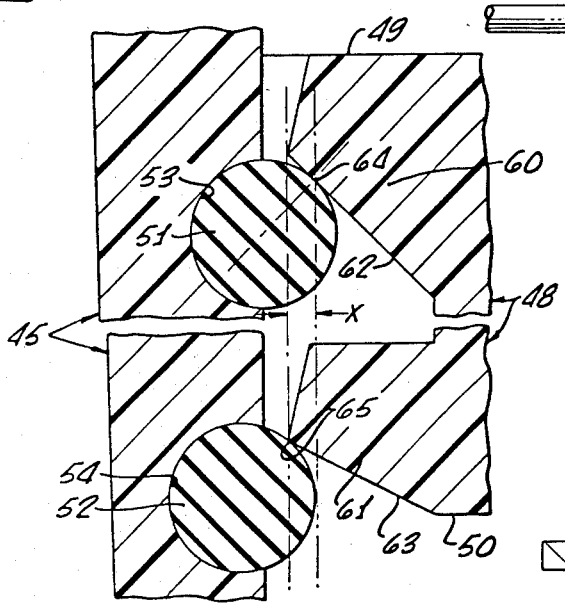
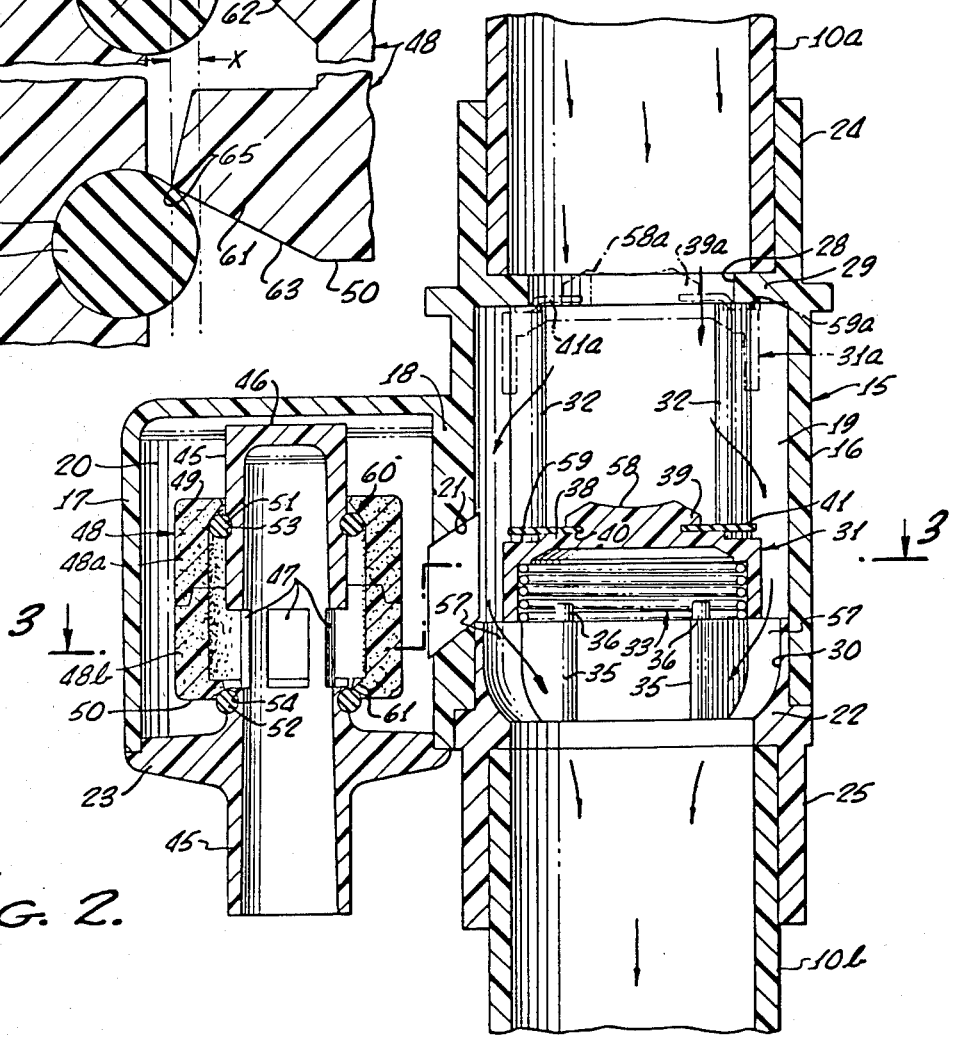
FIG. 2.

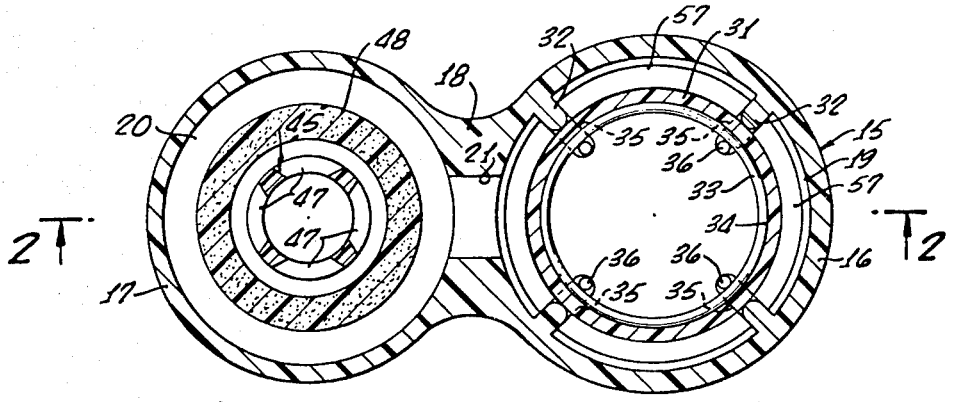
FIG. 3.
FIG. 4.
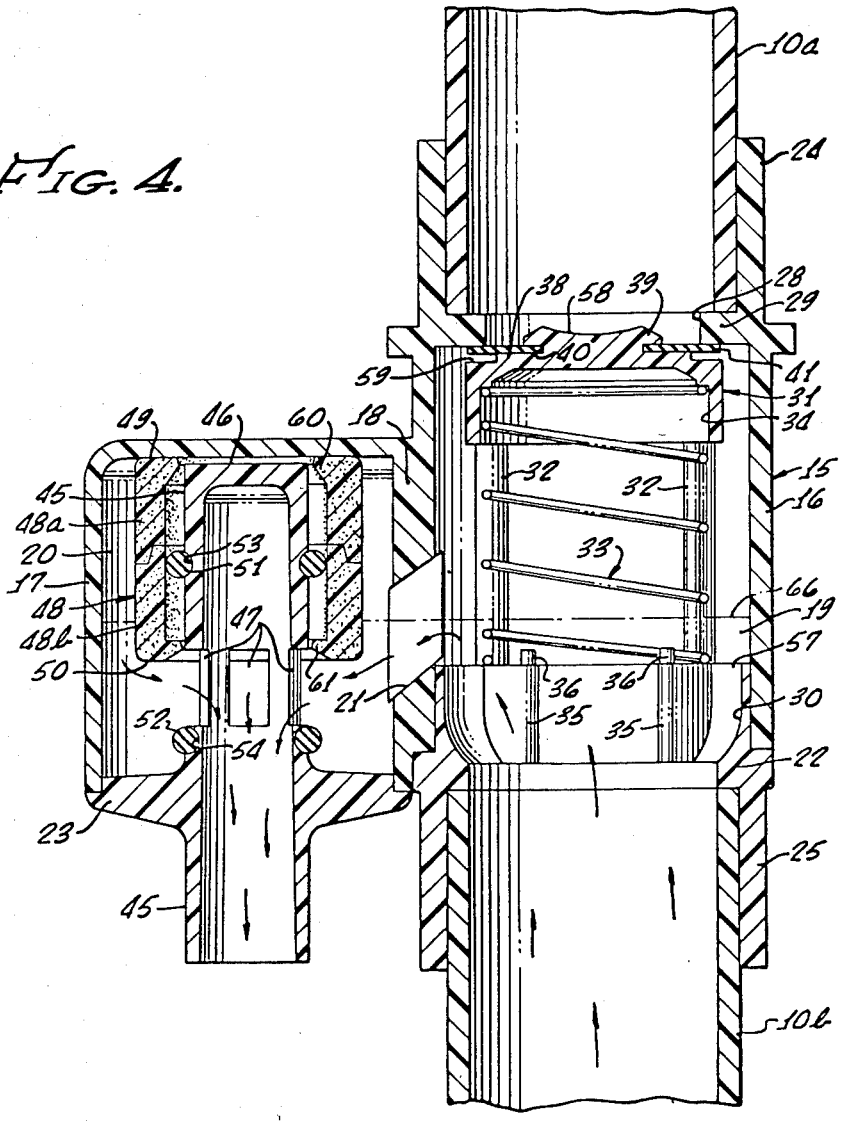

ANTI-BACKFLOW VALVE FOR THERAPY TUBS AND THE LIKE

FIELD OF THE INVENTION

This invention relates to valves, and more particularly, to a combination check, pressure relief and water separator valve for installation in an air blower discharge line of a therapy tub aeration system or the like to protect the blower from backflowing water in such line.

DESCRIPTION OF PRIOR ART

Low pressure air blowers used in aeration systems of therapy tubs and the like are particularly vulnerable to damage caused by tub water backflowing in their discharge lines and entering the blowers. Backflow problems are most acute in aeration systems of the type in which the blower discharge line is connected to venturi-type air and water mixers through which recirculating tub water is pumped prior to its discharge into the tub through outlet nozzles. Under certain circumstances, backflow problems can also occur in less sophisticated aeration systems where the blower discharge line forces air directly into the tub.

A conventional method of protecting the blower is to install an air check valve in a vertical portion of the discharge line adjacent the blower. However, this solution has proven less than satisfactory, especially where the air discharge line is connected to air and water mixers. Sustained nozzle blockage can cause a relatively great pressure to be exerted on the sealing element of such check valve. A slight leak in the element can allow tub water to be pumped directly into the blower, causing severe damage. Even in aeration systems where the blower discharge line is not connected to air and water mixers, tub water can seep upwardly through a defective check valve seal if the level of the water in the tub is above the level of the blower. This situation may occur, for example, where the blower is positioned at or slightly above the water level and the tub is overfilled, or upon shut off of the blower, which allows water from the tub to surge back into the line between the tub and blower.

Accordingly, it is an object of the present invention to provide a device which affords improved protection for such blowers and eliminates or minimizes abovementioned and other problems.

SUMMARY OF THE INVENTION

In carrying out principles of the present invention in accordance with a preferred embodiment thereof, a specially designed anti-backflow valve is installed in the discharge line of an air blower in an aeration system for a therapy tub or the like to protect the blower from damage caused by backflowing tub water. The valve comprises a housing having an air inlet, an air outlet, and a chamber communicating with the inlet and outlet. Means are provided for blocking fluid flow outwardly through the air inlet, for venting the chamber above a predetermined relief pressure therein, and for discharging water above a predetermined level therein. Thus, the valve may function, in sequence, as a check valve, a pressure relief valve, and a water separator valve in response to a backflow of water in the air discharge line.

According to one aspect of the invention, a single auxiliary outlet passage from the chamber is provided, and combined pressure relief and float valve means cooperate therewith to vent air and discharge water from the chamber. According to another aspect of the invention, the fluid flow-blocking means includes a spring-loaded check valve member within the chamber which blocks the air inlet to prevent fluid flow outwardly therethrough. The valve member has a concave face which greatly increases its separation from the air inlet during normal system operation, thereby improving the performance of the valve.

BRIEF DESCRIPTION OF THE DRAWINGS

FIG. 1 is a schematic illustration of a portion of a therapy tub aeration system in which an anti-backflow valve embodying principles of the present invention is installed;

FIG. 2 is a greatly enlarged cross-sectional view of the valve during normal operation of the system, taken along line 2—2 of FIG. 3;

FIG. 3 is a cross-sectional view of the valve taken along line 3—3 of FIG. 2;

FIG. 4 is a view similar to that of FIG. 2 illustrating a facet of the valve's operation during a backflow of water in the system; and FIG. 5 is a greatly enlarged, segmented view of a portion of the combined pressure relief and float valve mechanism of the valve in the position depicted in FIG. 2.

DETAILED DESCRIPTION

Schematically illustrated in FIG. 1 is a portion of an exemplary water aeration and injection system used in conjunction with a therapy tub or the like. In such system, a relatively low pressure air blower 9 delivers air through an air supply line or discharge pipe 10 to a number of venturi-type air and water mixers M (only one of which is shown) spaced around the perimeter of the tub below its water line 11. At each mixer water at a much higher pressure is forced (by a pump not shown) through an inlet 12, enters the mixer, forms a venturi therein, and is discharged into the tub through a wall nozzle 13 via a mixer outlet 14. The low pressure air entering the mixer is entrained in the water therein, thereby aerating the water injected into the tub.

Blockage of a sufficient number of nozzles (by, for example, the tub's users) can cause the water entering the mixers to be forced rearwardly through the air line 10 into the blower, causing severe damage. A conventional solution to this potential backflow problem is to install a check valve in a vertical section of the air line 10, the theory being that the back pressure in such line caused by a water flow reversal will quickly shut the valve and protect the blower.

Such common check valves usually do protect the blower against short surges of back pressure, the backflowing water pushing ahead of it a pocket of air which forms a compressible barrier between the water and the closed valve. However, the combination of sustained nozzle blockage and a worn or defective valve seal can quickly force the air and the water behind it rearwardly through the closed valve and into the blower when the air pocket reaches a sufficient pressure. Even if the check valve's seal is not worn or defective, a greatly increased air pocket pressure can simply rupture or displace the seal, allowing backflowing air and water to surge into and severely damage the blower.

Moreover, this backflow problem can occur even when the water pump and air blower are not operating—either in a system similar to that illustrated or in a less sophisticated one where the air and water are injected separately into the tub. As an example, if the blower is installed near the level of the water surface 11 (instead of well above it as illustrated in FIG. 1) and the tub is overfilled (i.e., to above the level of the blower), the head (i.e., the pressure due to the level of the water in the tub) of the tub water itself can force water to seep through the check valve and into the blower.

To solve these and other problems associated with the use of a conventional check valve, an anti-backflow valve 15 (which replaces such check valve) embodying principles of the present invention is installed in a vertical portion of the main air supply line 10 as indicated in FIG. 1. As will be seen, the valve 15 provides not one, but three separate modes of protection for the vulnerable air blower. First, the valve 15 functions as a check valve to protect the blower against short, relatively low pressure surges of backflowing water. Secondly, upon an increase in such back pressure as the backflowing water is forced closer to the valve, it functions as an air pressure relief valve. Finally, it functions as a water separator valve to discharge any backflowing water actually reaching it—before such water enters the blower.

GENERAL STRUCTURE

Referring to FIGS. 2, 3, and 4, the general structure of the valve 15 will first be described. The various components of the valve are contained within a molded synthetic resin housing having first and second generally cylindrical sections 16 and 17. The two housing sections are parallel and are connected in a side-by-side relationship by a common wall section 18 extending along the length of the housing section 17 which is shorter and of a lesser diameter than the housing section 16. A chamber in the valve 15 is defined by a main chamber 19 in the housing section 16, and an auxiliary chamber 20 in the housing section 17, the chambers 19 and 20 communicating through a port 21 in the common wall section 18. The bottom ends of the housing sections 16 and 17 are left open in the molding process and, respectively, have fixedly attached end caps 22 and 23 in the assembled valve.

Molded integrally with the upper end of the housing section 16 and the end cap 22, respectively, are axially projecting pipe collars 24 and 25 which receive upstream and downstream portions of the air discharge pipe 10 as indicated in FIGS. 2 and 4, and designated, respectively, as 10*a* and 10*b* in FIG. 4. A circular inlet opening 28 through the upstream end of the housing section 16 communicates with the chamber 19 and forms a radially inwardly projecting continuous circular interior flange 29 which functions as a valve seat as described below. Additionally, an outlet opening 30 is formed in the end cap 22 and communicates with the chamber 19.

The check valve function of the valve 15 is performed by a cylindrical valve member 31 having a diameter less than the inner diameter of the housing section 16 and the diameter of the outlet opening 30. The member 31 is mounted within the chamber 19 for vertical sliding movement, axially of the chamber, between an open position indicated in FIG. 2 and a closed position indicated in FIG. 4, by means of four radially inwardly projecting guiding ribs 32 (FIG. 3) molded integrally with the housing section 16 and extending axially along an upper portion of its length. The member 31 is biased upwardly toward its closed position by an axially extending helical spring 33 whose upper end is received within an opening 34 in the bottom end of the member 31 and whose lower end engages four ribs 35 molded integrally with the end cap 22 and extending radiallly inwardly of the outlet opening 30. Lateral movement of the bottom end of the spring 33 is precluded by upwardly projecting pins 36 on the ribs 35 which engage the inner surface of the bottom spring end as best indicated in FIG. 3.

Projecting upwardly from the upper end of the valve member 31 is a reduced cylindrical portion 38 having a diameter slightly smaller than that of the inlet opening 28. Extending upwardly from the cylindrical portion 38 is a still smaller diameter cylindrical portion 39 having a beveled upper end. A radially extending outwardly opening annular groove 40 is formed in portion 39 adjacent its juncture with the cylindrical portion 38. The groove 40 receives an inner radial portion of an elastomeric sealing ring or disc 41 having an outer diameter slightly smaller than that of the valve member 31. As will be seen, the valve member 31, the disc 41 and the flange 29 cooperate to seal the inlet 28 and provide the first stage of protection for the blower against backflowing water in the air line 10.

The second and third stages of blower protection are provided by the housing section 17 and components therein, a simple mechanism within the housing section 17 uniquely functioning, as will be seen, as a combined pressure relief and liquid separator valve. Molded integrally with the end cap 23 and having an upper portion extending vertically within the chamber 20 is a discharge member or tube 45 having a closed upper end 46 and four circumferentially spaced side inlet ports 47 formed through the tube wall. The ports extend upwardly from a point adjacent the end cap 23, and cooperate with the interior of the tube to define an auxiliary outlet passage from the valve 15. The lower end of drain tube 45 provides communication from the interior of the housing 17 to a drain (not shown) or to ambient atmosphere for discharge of air and water.

A hollow cylindrical float 48 having an upper end 49 and a lower end 50, both apertured to slidably receive the tube 45, circumscribes the tube and is slidably mounted thereon for movement between a lower or port-blocking position illustrated in FIG. 2 and an upper or port-unblocking position illustrated in FIG. 4. In its lower position, the float 48 extends both above and below the port 47 and its radially, inwardly extending upper and lower ends cooperate with O-rings 51 and 52 which are mounted in annular grooves 53 and 54 in the tube wall respectively above and below the ports 47 to form a seal between the float 48 and the tube 45 to thereby block the auxiliary outlet passage. As will be seen, a novel cooperation between the O-rings 51 and 52 and the float 48 permits the float and tube to function not only as a float valve for discharging water from the housing 15, but as an air pressure relief valve as well.

DETAILED STRUCTURE AND OPERATION

With the air blower and water pump of the aeration system of FIG. 1 turned off, the valve member 31 and its sealing gasket 41 are forced toward the air inlet 28 by the spring 33 and assume the position indicated in FIG. 4, the sealing disc 41 being pressed against and engaging the underside of the flange 29 and the cylindrical valve member section 39 projecting upwardly into the inlet opening 28. The chamber 20 is free of water and contains air at ambient pressure. The weight of the float 48 causes it to rest on the O-rings 51 and 52, thus blocking the outlet ports 47.

When the air blower is started, the air pressure in the upstream section 10*a* of the air line 10 forces the valve member 31 away from the inlet 28, causing an air flow downwardly through the chamber 19 and out the outlet 30 through passages 57 (FIG. 3) between the lower ribs 35. During normal system operation, the float 48 rests upon and seals against the O-rings 51 and 52, thus precluding discharge of air through the auxiliary outlet passage in the tube 45. The relatively low pressure output of the blower does not cause the valve to assume its pressure relief position.

As previously mentioned, the discharge operating pressure of the air blower is relatively low, being approximately 1 to 2 psi in aeration systems such as that illustrated. Despite such low operating pressure, it should be noted that the valve member 31 in its normal operating position, as depicted in FIG. 2, is bottomed out against the lower ribs 35, a deflection from its closed position of approximately 1½ inches in an embodiment of the present invention that has been built and operated and which is illustrated in FIG. 2. This surprisingly and unexpectedly large deflection is the result of a concave upper end surface 58 of the valve member 31. In development and testing such valve member 31, it was found that a flat or convex upper end surface or valve face such as that used in many conventional check valve members, yielded a downward deflection of only about ¼ inch. This configuration resulted in a relatively high pressure drop across the valve because of the restricted flow area between the gasket and valve seat. The formation of the concave surface 58, however, (without changing any other valve configuration or operating parameters) yields the unexpectedly large deflection (and concomitant increase in such flow area) which greatly reduces the pressure drop across the check valve and, therefore, significantly improves performance of the valve.

Upon an initial backflow of water in the air line 10, a pocket of air ahead of the water is pushed toward the inlet 28, causing an air flow reversal. This creates an air pressure opposing and overcoming the blower discharge air pressure which allows the spring 33 to return the valve member 31 to a closed position. As the backflowing water moves closer to the now closed valve 15, the pressure in the chambers 19 and 20 is increased as the air pocket ahead of the backflowing water is compressed by the water. The increased pressure in the chambers causes the valve member 31 to move slightly upwardly of the closed position indicated in FIG. 4 to the position indicated by dotted lines and reference numeral subscripts "a" in FIG. 2. In such position, an outer radial portion of the gasket 41 is compressed between the underside of the flange 29 and the peripheral upper surface 59 of the valve member 31, positively sealing the inlet 28 against outward fluid flow therethrough. As the backflowing water is pumped still closer to the valve 15, the pressure in the chambers 19 and 20 increases as the air pocket is further compressed. During such initial pressure increase, the float 48 remains in its port-blocking position indicated in FIG. 2. Where such surges of backflowing water are relatively short, the pressure buildup in the chambers 19 and 20 is relatively small and the components in the auxiliary chamber 20 are not called upon to provide additional protection for the air blower. When the water in the air line 10 begins to recede (i.e., when the discharge nozzles are unblocked), the chamber pressure decreases of its own accord until it is below the blower discharge pressure, whereupon the air blower again forces the valve member 31 away from its valve seat on the flange 29 and proper air flow through the valve continues.

However, when the backflowing water continues to approach the valve 15, a pressure buildup in the chambers 19 and 20 beyond a predetermined relief pressure therein causes the float 48 to lift slightly off the O-rings 51 and 52, thus allowing the chambers to be vented through the outlet ports 47 to relieve such pressure, thereby protecting the gasket 41 (and thus the air blower) from damage due to the air pressure buildup. This action can occur in response to increase in air pressure, even though the backflowing water has not yet reached the valve housing.

The unique construction of the float 48 and its cooperation with the O-rings 51 and 52 which causes the float to lift in response to a predetermined relief pressure within the chambers will now be described with particular reference to FIG. 5.

The cylindrical float 48 is formed from a suitable buoyant material such as urethane, weighs approximately one ounce in the illustrated embodiment, has a specific gravity of about 0.50, and has an axial opening therethrough having a minimum diameter slightly larger than the outside diameter of tube 45. Slightly inwardly of the upper and lower float ends 49 and 50, the opening is radially enlarged, thus forming radially inwardly projecting upper and lower lips 60 and 61, respectively, adjacent the upper and lower ends of the float. The lips 60 and 61 extend completely around the tube 45 and have lower surfaces 62 and 63, respectively, which slope inwardly and upwardly toward the tube 45.

Importantly, and providing a basis for pressure relief operation of the valve 15, the surface 62 has a substantially greater degree of slope than the surface 63.

The float 48 is constructed in two sections, an upper section 48*a* and a lower section 48*b* (FIGS. 2 and 4). To install the float on the tube, the lower O-ring 52 is first placed in its groove 54. Next, the lower float section 48*b* is dropped on the tube 45. The upper O-ring is then placed in its groove 53. Finally, the upper float section 48*a* is dropped on the tube over the upper O-ring and fastened to the lower float section 48*b* with a suitable waterproof adhesive. The axially spaced O-rings 51 and 52 are positioned axially on the tube 45 so that the lip surfaces 62 and 63, with the float 48 in its lower position, rest upon and form seals with the O-rings 51 and 52.

In the illustrated embodiment the O-rings 51 and 52 are identical in size and each projects radially outwardly of tube 45. However the groove 53 is slightly shallower than the groove 54. Thus, the upper O-ring 51 projects radially outwardly further than the lower O-ring 52 does. This relative radial offset of the two O-rings, coupled with the difference in slopes of the lower lip surfaces 62 and 63, causes the circular contact and sealing lines 64 and 65 between the upper and lower lips and their O-rings to be relatively radially offset as well—the circular contact line 64 being offset outwardly of the circular contact line 65 by a distance X as indicated in FIG. 5. Stated otherwise, the radius of the circular contact line 64 is greater than the radius of the circular contact line 65 by the distance X. With the float 48 in its lower position, in which it sealingly engages the O-rings, the effective area over which chamber unit pressure is exerted upon the bottom float end 50 is slightly larger than the effective area over which chamber unit pressure is exerted upon the upper float end 49, the differential area being an annular ring having a width X. This reduction in the effective chamber unit pressure area of the upper end of the float relative to the lower float end produces a net upward differential total pressure upon the float when seated upon the O-rings and when chamber unit pressure is greater than the ambient pressure within the tube 45.

Because of this differential area and differential pressure, when the chamber air pressure (unit pressure) is increased by backflowing water in the air line 10 to a point where the differential pressure is greater than the weight of the float, the float is lifted off the O-rings 51 and 52, exposing the ports 47 and relieving the chamber pressure. The relief pressure at which the chamber is vented by such operation of the float 48 is a function both of the weight of the float and the distance X. Thus, by varying either or both of these parameters, a relief pressure higher than the operating pressure of the air blower by a predetermined amount may be selected. In the illustrated embodiment of the valve 15, in which the operating pressure of the air blower is approximately 2 psi, the relief pressure is approximately 10 psi. This differential (between 2 and 10 psi) keeps the float in its lower position during normal operation of the aeration system and during short, relatively low pressure back surges of air and water, but permits the float to lift at a pressure well below that which would potentially damage the gasket 41 or cause it to leak.

The illustrated configuration of the tube 45, the float 48 and the O-rings 51 and 52 represents a particularly simple and inexpensive construction method by which to obtain the desired pressure differential on the float 48 as the chamber pressure increases. However, if desired, other configurations of these elements could be employed to carry out principles of this aspect of the present invention, as long as the circular engagement lines between the float and the O-rings are spaced radially apart as previously described. For example, the radial extent of the float lip surfaces and/or the relative size and position of the O-rings could be varied.

When the float 48 is lifted in response to a chamber pressure greater than the predetermined relief pressure, the chamber is quickly vented and chamber pressure drops, thus permitting backflowing water to more quickly approach the main chamber 19 as the chamber is vented. After the chamber pressure falls below the value at which the relief valve is set to open, the float 48 falls to its lower position once again. Water entering the main chamber 19 flows through the port 21 into the auxiliary chamber 20. As the water level in the chamber 20 rises above the bottom end 50 of the float 48, the float, because of its buoyancy, is lifted from its lower position, exposing the discharge ports 47 and continuously draining the incoming water through the tube 45 before it reaches the level of the inlet 28. Thus, the float is operable to open the discharge port in response to either air pressure or water level.

It should be noted that, unlike conventional check valves used in this application, a leak in the gasket 41 does not destroy the effectiveness of the valve 15 in keeping backflowing water out of the blower. Such a leak only hinders the valve's first two stages of blower protection, its remaining water separating function being unaffected by the leak.

When the backflow of water stops, the water level 66 (FIG. 4) in the chambers 19 and 20 recedes, and the float 48 once again drops to its closed position. As the water in the air line 10 drains back into the mixers, the discharge pressure of the air blower causes the valve member 31 to open again and the system is returned to its normal operation.

The illustrated and described valve 15 is adapted for installation in a vertical section of an air discharge line as illustrated in FIG. 1, such location being typical for conventional therapy tub aeration systems. However, it should be apparent to one skilled in the art that the illustrated valve configuration could easily be modified to adapt the valve for installation in a horizontal air supply line. Moreover, while the valve 15 is particularly suited for use in therapy tub aeration systems, it could also be used in a variety of other applications in which it is desired to preclude liquid backflow in a gas supply line.

The foregoing detailed description is to be clearly understood as given by way of illustration and example only, the spirit and scope of this invention being limited solely by the appended claims.

What is claimed is:

1. An anti-backflow valve adapted to be installed in a pipe to permit gas flow in one direction and to preclude flow of a liquid in the pipe in the opposite direction, said valve comprising:

(a) a housing having a gas inlet, a gas outlet, and a chamber communicating with said inlet and outlet;

(b) means for preventing fluid flow outwardly through said inlet;

(c) means for venting said chamber in response to a pressure therein greater than a predetermined relief pressure; and (d) means for draining said chamber in response to the presence of liquid therein above a predetermined level, said means for venting said chamber comprising said means for draining said chamber.

2. An anti-backflow valve adapted to be installed in a pipe to permit gas flow in one direction and to preclude flow of a liquid in the pipe in the opposite direction, said valve comprising:

(a) a housing having a gas inlet, a gas outlet, and a chamber communicating with said inlet and outlet;

(b) means for preventing fluid flow outwardly through said inlet;

(c) means for venting said chamber in response to a pressure therein greater than a predetermined relief pressure; and (d) means for draining said chamber in response to the presence of liquid therein above a predetermined level, said means for venting and said means for draining comprising, in common, a discharge port in said chamber and a port closure member for unblocking said discharge port in response to either gas pressure or liquid above selected levels.

3. An anti-backflow valve adapted to be installed in an air blower discharge line of a therapy tub aeration system to protect the blower from backflowing tub water in the discharge line, said valve comprising:

(a) a housing having an air inlet, an air outlet, and a chamber communicating with said air inlet and outlet;

(b) means defining an auxiliary outlet passage from said chamber remote from said air inlet and outlet;

(c) check valve means in said chamber for blocking fluid flow outwardly through said air inlet; and (d) combined pressure relief and float valve means in said chamber for normally blocking said auxiliary outlet passage and for opening said auxiliary outlet passage in response to a pressure in said chamber above a predetermined relief pressure or the presence of water in said chamber above a predetermined level.

4. The anti-backflow valve of claim 3 wherein said pressure relief and float valve means include a float mounted in said chamber for movement between a first position in which said float blocks said auxiliary outlet passage and a second position in which it does not, said float having an upper end and a lower end, and means for creating a pressure differential on said float in said first position to move it toward said second position in response to a chamber pressure higher than said predetermined relief pressure.

5. The anti-backflow valve of claim 3 wherein said means for defining an auxiliary outlet passage comprises a discharge member at least partially within said chamber, said discharge member having an inlet port within said chamber and a discharge outlet, wherein said float is mounted on said discharge member for movement up and down thereon, said float in said first position blocking said port, and wherein said means for creating a pressure differential on said float comprises cooperating means on said discharge member and said float for reducing the effective chamber unit pressure area of the upper end of said float relative to the lower end thereof when said float is in said first position.

6. The anti-backflow valve of claim 5 wherein said cooperating means include first and second O-rings respectively circumscribing said discharge member above and below said port, said float circumscribing said discharge member and having inwardly projecting annular lips adjacent said upper and lower ends that respectively rest upon said first and second O-rings when said float is in said first position to form therewith a seal between said float and discharge member above and below said port along a first sealing line around said discharge member above said port and a second sealing line around said discharge member below said port, said first sealing line being spaced radially outwardly of said second sealing line.

7. The anti-backflow valve of claim 6 wherein said first and second O-rings are substantially identical in size, and wherein said discharge member has a first annular groove above said port and a second annular groove below said port, said first and second O-rings being received, respectively, in said first and second grooves, said second groove being deeper than said first groove, whereby said first O-ring is spaced radially outwardly of said second O-ring.

8. The anti-backflow valve of claim 6 wherein the lower surfaces of said annular lips are sloped upwardly toward said discharge member and wherein the slope of said lower surface of the upper float lip is greater than the slope of said lower surface of the lower float lip.

9. The anti-backflow valve of claim 3 wherein said check valve means includes a spring-loaded valve member positioned in said chamber to block said air inlet in the absence of inward fluid flow therethrough, said valve member having a concavely shaped valve face thereon for cooperating with even a relatively low pressure inward fluid flow through said air inlet to create a relatively large separation between said valve member and said inlet in response to said inward fluid flow.

10. A therapy tub or the like having an aeration system comprising:

(a) a tub, (b) an air discharge line connected to flow air into water contained in said tub;

(c) an air blower connected to said discharge line to blow air therethrough; and (d) an anti-backflow valve as recited in claim 3 installed in said discharge line to protect said blower from backflowing tub water in said discharge line.

11. The apparatus of claim 10 further comprising:

a discharge nozzle mounted on a wall of the tub below its water line; and a venturi-type air and water mixer having an air inlet, a water inlet, and a mixture outlet connected to said nozzle, said discharge line being connected to said air inlet of said mixer.

12. A combined air pressure relief and water discharge valve for protecting an air blower of a pool, spa, therapy tub or the like against backflowing water and air pressure surges, said valve comprising:

(a) a chamber adapted to communicate with the discharge side of an air blower to be protected;

(b) a discharge port in said chamber;

(c) a discharge port closure member movably mounted in said chamber for motion between port blocking and unblocking positions, said closure member including means responsive to air pressure in said chamber for applying a differential air pressure to said closure member to shift said closure member to said unblocking position to relieve air pressure within said chamber; and (d) means for discharging water from said chamber, said means for discharging water from said chamber comprising said discharge port, said closure member being buoyant and being mounted for movement up and down between said positions in response to the level of water in said chamber.

13. In an air check valve adapted to be installed in a discharge line of an air blower in a therapy tub aeration system and having an air inlet, an air outlet, a chamber communicating with said inlet and outlet, and means for preventing fluid flow outwardly through said inlet, the improvement comprising:

(a) means for venting said chamber when the pressure therein exceeds the blower discharge operating pressure by a predetermined amount to thereby protect said fluid flow-preventing means upon occurrence of a forced backflow of water toward said outlet; and (b) means for forming a drainage passage from said chamber in response to the presence of water therein above a predetermined level, each component of said venting means comprising a component of said drainage passage-forming means.

14. The method of protecting an air blower of an aeration system for a therapy tub or the like from backflowing water in the discharge line of the blower, said method comprising the steps of:

(a) blocking the discharge line, in response to a backflow of water therein, at a first point ahead of the backflowing water;

(b) venting the discharge line at a second point between said first point and the backflowing water in response to a discharge line pressure above the operating pressure of said blower, and (c) draining the backflowing water from said discharge line as it approaches said first point.

15. An anti-backflow valve adapted to be installed in an air blower discharge line of an aeration system to protect the blower from backflowing water inthe discharge line, said valve comprising:

(a) a housing having an air inlet, an air outlet and a chamber communicating with said inlet and outlet;

(b) means in said chamber defining a combined drain and relief port; and (c) normally closed valve means in said chamber responsive to either air pressure within said chamber above a predetermined value or a water level within said chamber above a predetermined value for opening said combined relief and drain port.

* * * * *